United States Patent [19]

Haynes

[11] Patent Number: 4,658,622

[45] Date of Patent: Apr. 21, 1987

[54] ROLLING MILL

[75] Inventor: Ralph G. Haynes, Sheffield, England

[73] Assignee: Davy McKee (Sheffield) Limited, Sheffield, England

[21] Appl. No.: 796,862

[22] Filed: Nov. 12, 1985

[30] Foreign Application Priority Data

Nov. 16, 1984 [GB] United Kingdom ..... 8428981

[51] Int. Cl.[4] ..... B21B 35/14; B21B 31/22; B21B 31/32

[52] U.S. Cl. ..... 72/249; 72/240; 72/248; 74/397

[58] Field of Search ..... 72/249, 235, 248, 240; 464/162; 74/397

[56] References Cited

U.S. PATENT DOCUMENTS 2,124,677 7/1938 Talbot ..... 72/248
3,600,925 8/1971 Field et al. ..... 72/249 X
4,411,170 10/1983 Vogelgesang ..... 72/249 X
4,497,215 2/1985 Gronbech et al. ..... 72/248 X

*Primary Examiner*—Lowell A. Larson
*Assistant Examiner*—Steve Katz
*Attorney, Agent, or Firm*—Walter H. Schneider

[57] ABSTRACT

An edger mill comprising a pair of oppositely mounted vertical rolls adapted for relative movement whereby the gap between them can be adjusted. Each roll is provided with a drive including a drive shaft comprising two drive sections extending generally parallel to the direction of roll gap adjustment. The first drive section has a splined portion coupled to a drive pinion for accommodating large adjustments effected in the roll gap when the mill is not under load. The second drive section is connected to the first drive section by a splined coupling which accommodates small roll gap adjustments effected when the mill is under load.

9 Claims, 7 Drawing Figures

ROLLING MILL

TECHNOLOGICAL BACKGROUND

This invention relates to rolling mills, and particularly to an edger mill of the type having a pair of vertical rolls, the gap between which can be adjusted.

The edger mill has some means effective to adjust the roll gap between the rolls and, for each roll, a drive. The drive usually has a drive shaft extending generally parallel to the direction of roll gap adjustment and has a splined portion coupled to a drive pinion for accommodating variations in roll gap. The drive for the edger mill described is satisfactory provided that roll gap adjustment is effected when the mill is not under load. If however it is desired to modulate the roll gap during rolling, for example for the purpose of edge rolling slabs in the manner described in British patent specification No. 1316959, then excessive wear of the splined portion of the drive shaft occurs, and frequent remedial work on the drive is necessitated.

SUMMARY OF INVENTION

An object of the invention is to avoid or alleviate the problem of rapid wear of the splined portion. According to one aspect of the present invention there is provided an edger mill comprising: a pair of vertical rolls, roll gap adjustment means effective to adjust the roll gap between the rolls and, for each roll, a drive including a drive shaft extending generally parallel to the direction of roll gap adjustment and having a splined portion coupled to a drive pinion and accommodating variations in roll gap, and a splined coupling which is interposed in the drive between the drive pinion and the roll to accommodate relatively small variations in roll gap during rolling. Gross roll gap adjustments effected when the mill is not under load may then be accommodated by the splined portion of the shaft, while relatively minor roll gap modulations under load are accommodated by the splined coupling which may be constructed sufficiently robustly to operate under those conditions.

Preferably actuating means are mounted to act between ends of the splined coupling to enable the coupling to be brought to a datum axial position before rolling is commenced.

Other features and objects of the invention will become apparent from the following description of an edger mill in accordance therewith.

DESCRIPTION OF PREFERRED EMBODIMENT

Figure 1:
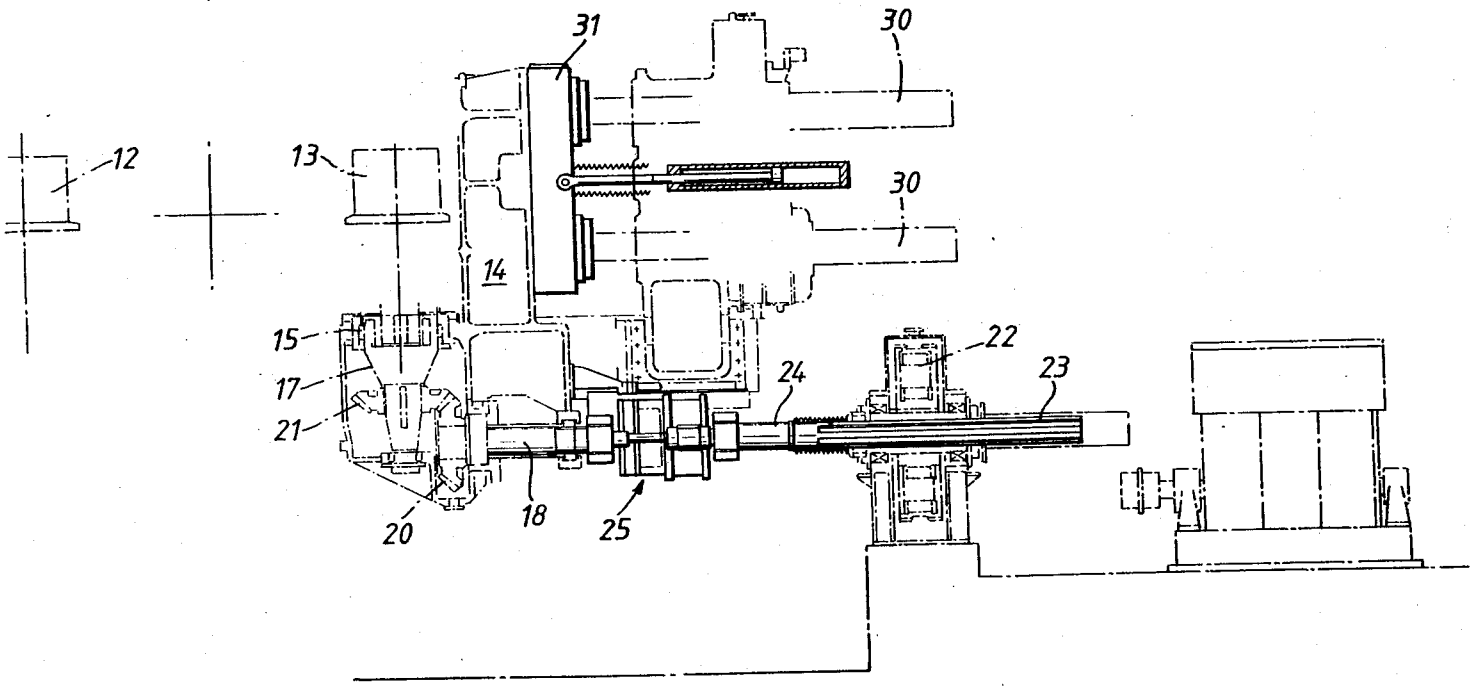
FIG. 1 is a side view showing the right hand part of the edger mill.

The edger mill shown in the drawings has a pair of vertical edger rolls which are schematically indicated at 12 and 13. Each roll is rotatably carried by a carrier, the carrier for the roll 13 being indicated at 14. In particular, the carrier 14 supports through bearings 15 and 16 a drive sleeve 17 for roll 13. Carrier 14 also carries a short shaft 18 having at its left hand end a mitre gear 20 coupled to a mitre gear 21 on the drive sleeve 17.

Roll 13 is driven by a drive pinion 22 having internal gear teeth meshing with a splined portion 23 of a drive shaft 24, which is connected to the short shaft 18 through a splined coupling assembly 25. Roll 12 is similarly mounted and driven. Shafts 18 and 24 are coaxial and are approximately at right angles to the axes of the rolls 12 and 13, i.e. they extend in the direction of roll gap adjustment.

The roll gap between rolls 12 and 13 is adjusted by varying the separation of the carriers 14. Large changes in roll gap are effected by screws 30 acting on each carrier through a hydraulic capsule assembly 31, which is used to effect relatively minor roll gap changes during rolling. Piston and cylinder assembly 32 when operated retracts the carrier 14 to cause the latter to follow any backward movement of the screws 30 and provides the force necessary to collapse the hydraulic capsule assembly 31. The adjustment and drive of roll 12 are similar to those of roll 13.

Gross changes in roll gap effected when the mill is not under load are accommodated by the movement of the relatively long splined portion 23 of the drive shaft 24 within the drive pinion 22. The axially adjustable coupling provided by parts 22 and 23 is not however required to accommodate relatively minor roll gap adjustments when the mill is under load, since such working results in rapid wear of the splines. Small under load roll gap variations, such as those required in order to operate according to British patent specification No. 1316959, are taken up by the splined coupling assembly 25, which is shown in greater detail in FIGS. 2 and 3.

Figure 2A:
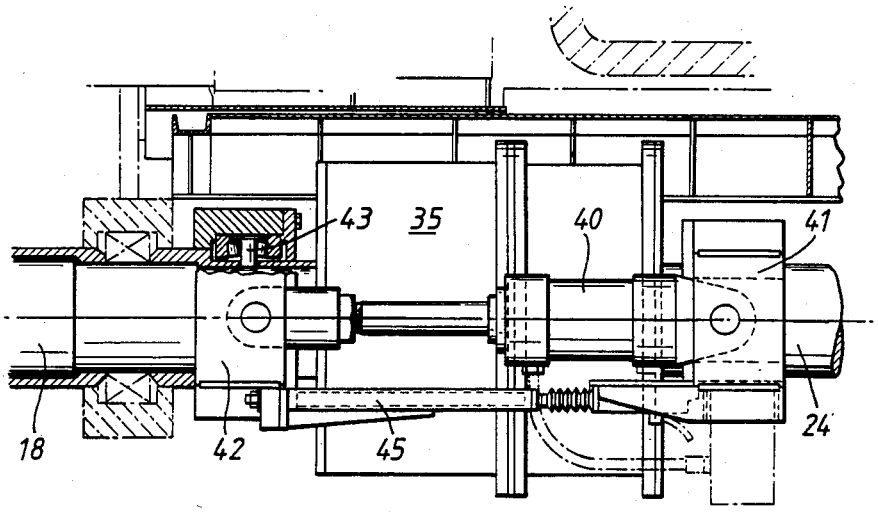
FIGS. 2A, 2B and 2C are respectively a side view, an end view and a part-plan view of the splined coupling assembly shown in FIG. 1, FIGS. 3A and 3B are respectively end and side views of the splined coupling.
Figure 2B:
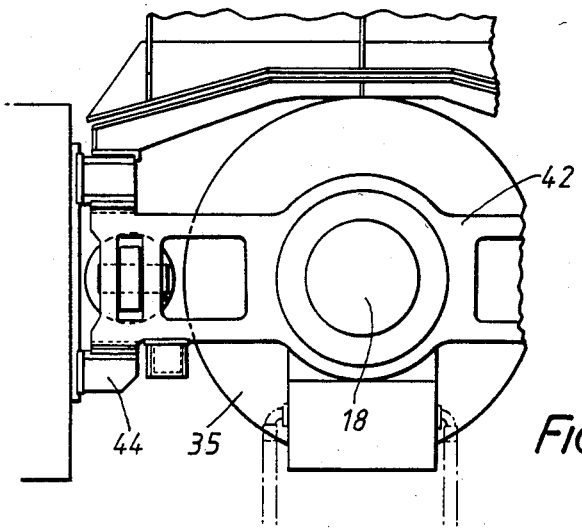
Figure 2C:
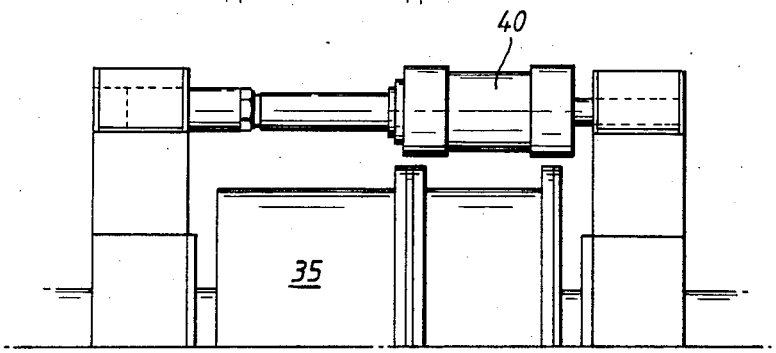
Figure 3A:
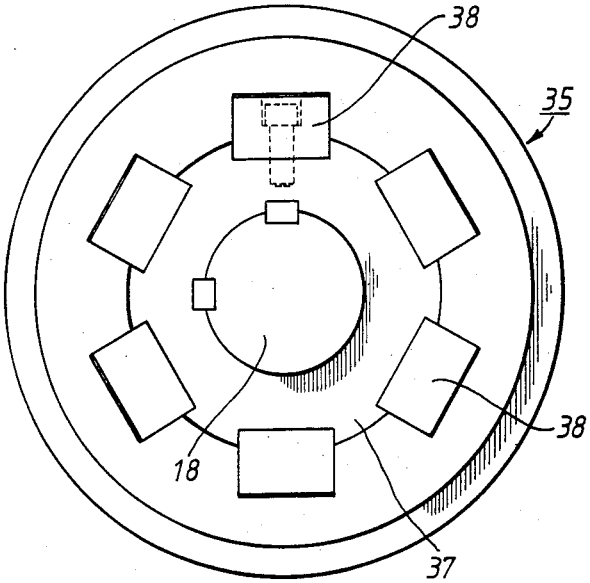
Figure 3B:
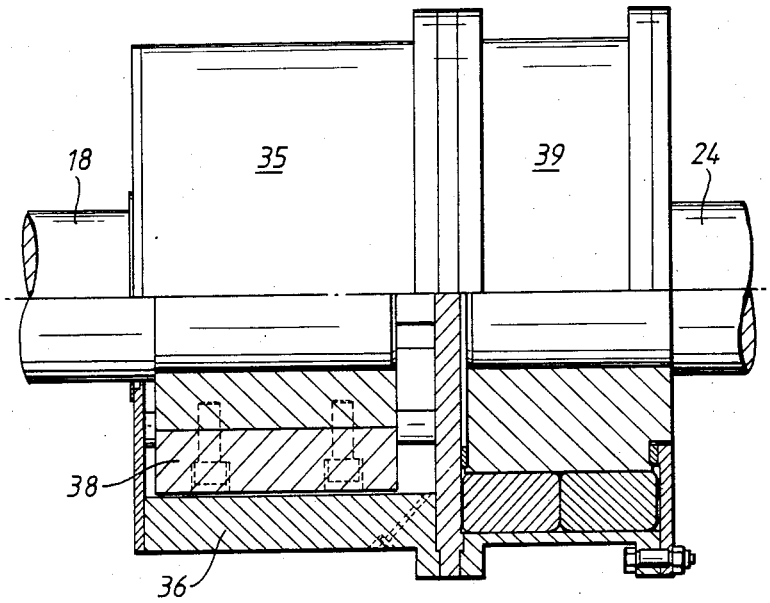

As shown in FIGS. 3A and 3B, the assembly 25 includes a large diameter splined coupling 35 consisting of an outer sleeve 36 connected to shaft 24 via a flexible coupling 39. A hub 37 is operatively secured to the drive shaft 18. The splines of the splined coupling take the form of replaceable phoshor bronze keys 38 which are bolted to the hub 37 and are received in slots in the sleeve 36. Hub 37 can thus move axially within the sleeve 36. The splined coupling 35 is bridged by a pair of piston and cylinder assemblies 40, which are pivoted at their ends to crossheads 41 and 42. The crossheads 41 and 42 are mounted on shafts 24 and 18 respectively through thrust bearings, one of which is shown in FIG. 2A at 43. The ends of the crossheads are received in fixed slideways 44 (FIG. 2B). By the operation of the piston and cylinder assembly 40, the separation between the two shafts 18 and 24 can be varied. Position transducers 45 are arranged between the crossheads so as to monitor their separation.

As before mentioned, gross roll gap variations effected prior to rolling are accommodated by the movement of the splined portion 23 of drive shaft 24 within the pinion 22. During that adjustment, the hydraulic capsule assembly 31 and the piston and cylinder assemblies 40 are locked so that no adjustment of the splined coupling 35 is effected. During rolling the tranducers 45 are used to control the movement of the cylinders 40 to ensure the splined coupling 35 moves in synchronisation with the hydraulic capsule assembly 31 during minor roll gap modulation. The large diameter of the splined coupling reduces the localised torque on the sliding parts of the coupling. When rolling commences, the cylinders 40 are vented to enable the splined coupling 35 to accommodate minor roll gap modulation, the splined portion 23 at that time remaining axially stationary within the pinion 22.

Figure 4:
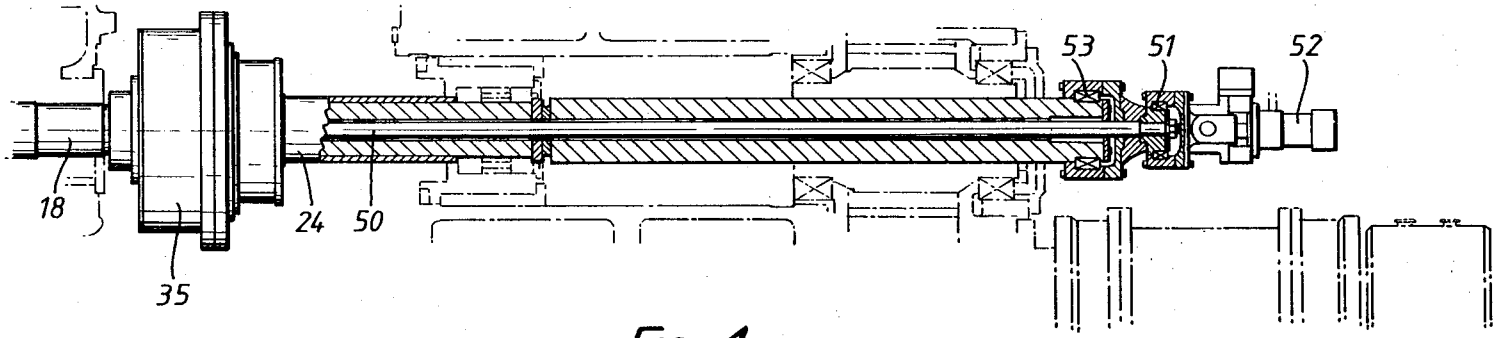
FIG. 4 illustrates a modification.

The alternative arrangement shown in FIG. 4 may be employed where there is insufficient space to accommodate the crossheads 41 and 42. In the FIG. 4 arrangement, the splined drive shaft 24 has an axial push rod 50, which is attached at one end to the shaft 18 and which at the other end extends out of the shaft 24 and is connected through bearing 51 to the piston of a piston and cylinder assembly 52. The cylinder of the assembly 52 is in turn connected through bearing 53 to the exterior of shaft 24. Operation of the piston and cylinder assembly 52 then performs the function provided by the assemblies 40 in the arrangement shown in FIG. 2.

What I claim is:

1. An edger mill comprising two opposite vertical rolls providing a roll gap therebetween each of which is mounted on a carrier for rotation about its axis; means associated with each roll carrier for effecting large adjustments in said roll gap when said mill is not under load; means associated with each roll carrier for effecting small adjustments in said roll gap when said mill is under load; a drive means for each roll extending essentially perpendicular to the axis of said roll, said means comprising first and second coaxial drive sections the first of which is provided with a splined end coupled to a drive pinion for driving it, said splined end accommodating large adjustments in said roll gap effected when said mill is not under load; a splined coupling connecting the other end of said first drive section to one end of said second drive section, said splined coupling accommodating small adjustments in said roll gap effected when said mill is under load; and interconnecting drive means connecting the other end of said second drive section to said roll.

2. An edger mill according to claim 1 in which said splined coupling comprises an outer sleeve provided with internal slots connected to said other end of said first drive section, and a hub connected to said one end of said second drive section provided with splines adapted to be slidably received in said internal slots.

3. An edger mill according to claim 2 in which said hub splines are replaceable keys.

4. An edger mill according to claim 2 in which said outer sleeve is connected to said other end of said first drive section through a coaxial flexible coupling.

5. An edger mill according to claim 1 in which actuating means are provided to act between the ends of said splined coupling to enable said coupling to be brought to a datum axial position before rotation of said roll is commenced.

6. An edger mill according to claim 5 in which said actuating means is a piston-cylinder assembly.

7. An edger mill according to claim 6 in which two piston-cylinder assemblies bridge said splined coupling the respective ends of which are secured to said first and second drive sections by means of crosshead and thrust bearing assemblies.

8. An edger mill according to claim 7 in which a transducer means is provided to monitor the separation of the splined coupling.

9. An edger mill according to claim 6 in which a coaxial rod is mounted within said first drive section one end of which is connected to said one end of said second drive section and the other end of which extends beyond the one end of said first drive section and connects to a piston-cylinder assembly mounted on said first drive section.

* * * * *